US012534268B2

(12) United States Patent
Armstrong

(10) Patent No.: US 12,534,268 B2
(45) Date of Patent: Jan. 27, 2026

(54) COMPUTER VISION CHECKOUT BASKET AND METHOD OF USE THEREOF

(71) Applicant: NCR Voyix Corporation, Atlanta, GA (US)

(72) Inventor: Kenn Armstrong, Marietta, GA (US)

(73) Assignee: NCR Voyix Corporation, Atlanta, GA (US)

( * ) Notice: Subject to any disclaimer, the term of this patent is extended or adjusted under 35 U.S.C. 154(b) by 70 days.

(21) Appl. No.: 18/380,882

(22) Filed: Oct. 17, 2023

(65) Prior Publication Data

US 2025/0121983 A1 Apr. 17, 2025

(51) Int. Cl.
*B65D 21/08* (2006.01)
*B65D 25/28* (2006.01)

(52) U.S. Cl.
CPC ..... *B65D 21/086* (2013.01); *B65D 25/2802* (2013.01); *B65D 25/2835* (2013.01)

(58) Field of Classification Search
CPC ..... B65D 21/086; B65D 11/1833
See application file for complete search history.

(56) References Cited

U.S. PATENT DOCUMENTS

| | | | | |
|---|---|---|---|---|
| 4,624,382 | A * | 11/1986 | Tontarelli | A45C 5/045 220/8 |
| 5,746,342 | A * | 5/1998 | Jacques | B65D 1/246 220/6 |
| 5,911,338 | A * | 6/1999 | Miller | B65D 21/086 220/666 |
| 6,315,151 | B1 * | 11/2001 | Hupp | B65D 21/086 220/666 |
| 8,800,807 | B2 * | 8/2014 | Alvares | B65D 7/46 220/672 |
| 2019/0373994 | A1 * | 12/2019 | Zemel | A45C 5/045 |
| 2021/0000561 | A1 * | 1/2021 | Görz | A61B 50/33 |

* cited by examiner

*Primary Examiner* — Stephen J Castellano
(74) *Attorney, Agent, or Firm* — Notaro, Michalos & Zaccaria P.C.; John S. Economou

(57) ABSTRACT

A collapsible shopping basket has a rectangular base with two opposing sides, two opposing ends, and a central portion for supporting items to be purchased. A top rim has two opposing sides and two opposing end. Two vertically collapsible side walls and two vertically collapsible end walls are each coupled at a lower end to the rectangular base and at an upper end to an associated one of the two opposing sides or ends of the top rim. Two handles are coupled to the top rim. The vertically collapsible side walls and end walls are movable between an expanded position and a collapsed position. Each vertically collapsible side walls and each vertically collapsible end walls are positioned so as to not obscure any part of the central portion of the rectangular base when in the collapsed position thereof.

13 Claims, 5 Drawing Sheets

COMPUTER VISION CHECKOUT BASKET AND METHOD OF USE THEREOF

FIELD

This disclosure relates generally to a checkout basket for a computer vision checkout system and a self-checkout terminal, and more particularly to a checkout basket for a computer vision checkout system and a self-service checkout terminal which in use improves the speed of the checkout process.

BACKGROUND

A vision system for use with a self-service checkout terminal is a technology that incorporates computer vision and image processing techniques to enable automated product recognition, item tracking, and transaction handling in a self-checkout environment. The vision system uses cameras and specialized software to capture, analyze, and interpret visual information from the items being scanned by customers. The vision system interfaces with software in the self-checkout terminal to relay the recognized items, quantities, and prices. The vision system must be coupled via an interface to the point-of-sale (POS) system in the self-service checkout terminal and automates the transaction process by sending the item details for pricing, discounts, and payment processing. By leveraging a vision system, self-service checkout terminals provide a more efficient and streamlined experience for customers, reduce reliance on manual intervention, minimize errors, and improve overall accuracy and convenience during the checkout process.

Traditional self-service checkout terminals require a barcode on each item to be scanned separately. Vision systems speed the checkout process by processing groups of items at the same time. However, customers must place all of the items to be purchased into the field of view of the several cameras in the vision system ("the scan zone") and remove any obstructions to viewing such items. Because the cameras in the vision system are positioned at angles to the scan zone, it is not possible to scan items located in a conventional shopping basket. This means that, for every transaction, a customer must unload their basket, place all of their items into scan zone, and then move all their items from the scan zone to their shopping bag once the transaction is completed. The scan zone must also be provided with a standardized background in order for the vision system to properly operate, which can be expensive to install in retrofit applications and requires periodic maintenance to keep clean, etc.

The present disclosure describes a technical solution that solves the above-noted technical problems.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

The present disclosure describes embodiments of a collapsible shopping basket specifically adapted for use with a computer vision-based self-service checkout system. The collapsible shopping basket provides a significant checkout speed advantage over traditional self-service checkout systems and a computer vision-based self-service checkout systems that require each of the items to be purchased to be separately moved onto the scan zone by hand, and then separately bagged, during the checkout process. During use, a customer fills the collapsible shopping basket with items to be purchased and then positions the collapsible shopping basket on the scan zone area of the computer vision-based self-service checkout system. The side walls of the shopping basket collapse, as shown below, in order to allow the computer vision-based self-service checkout system to automatically process all of the items in the shopping basket. The bottom surface of the collapsible shopping basket is also selected to provide a uniform image background like the background used in training of the vision system when the items are initially scanned and stored into a database in order to ensure proper performance of the computer vision-based self-service checkout system. The use of the disclosed collapsible shopping basket speeds up the checkout process by eliminating the need to move items from a basket to the scan zone. In some cases, the collapsible shopping basket may be available for purchase, thus allowing a customer to take the basket home with the purchased items, further speeding the checkout process by eliminating the need to move purchased items to a separate shopping bag after completing the transaction.

Figure 1:
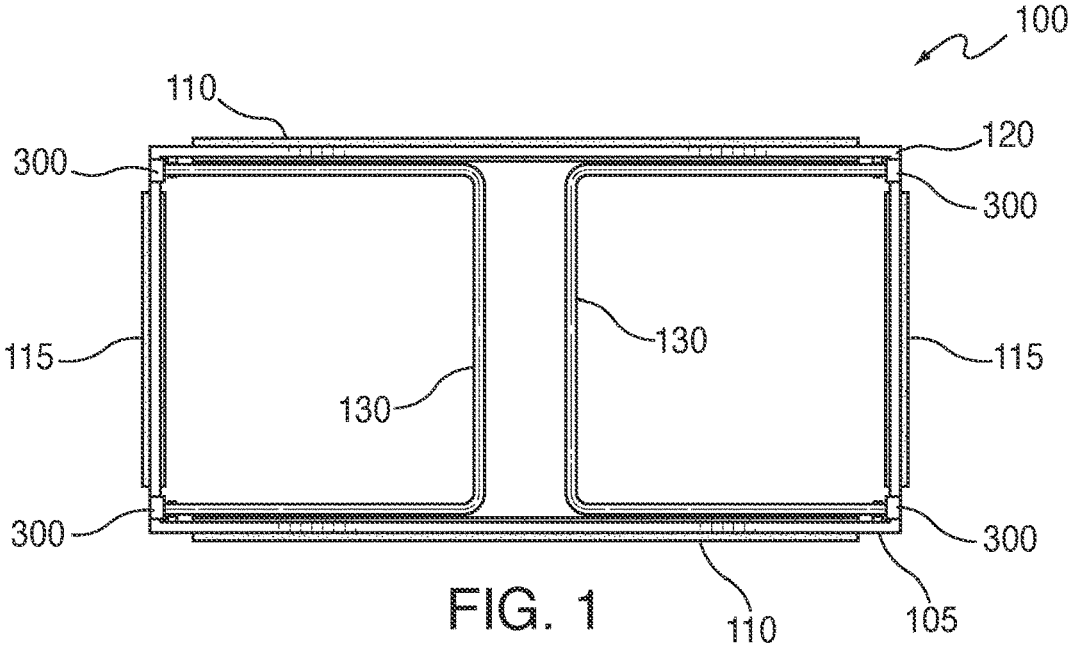
FIG. 1 is a top view of a first embodiment of a collapsible shopping basket according to the present disclosure.
Figure 2:
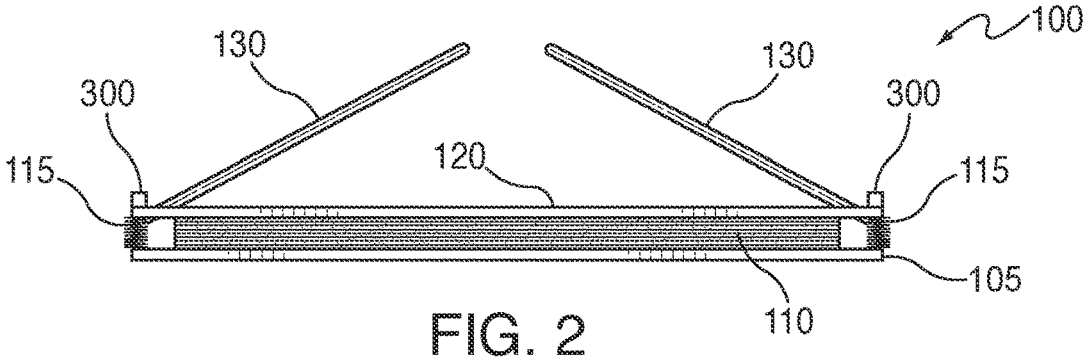
FIG. 2 is a side view of the collapsible shopping basket of FIG. 1 in collapsed form.
Figure 3:
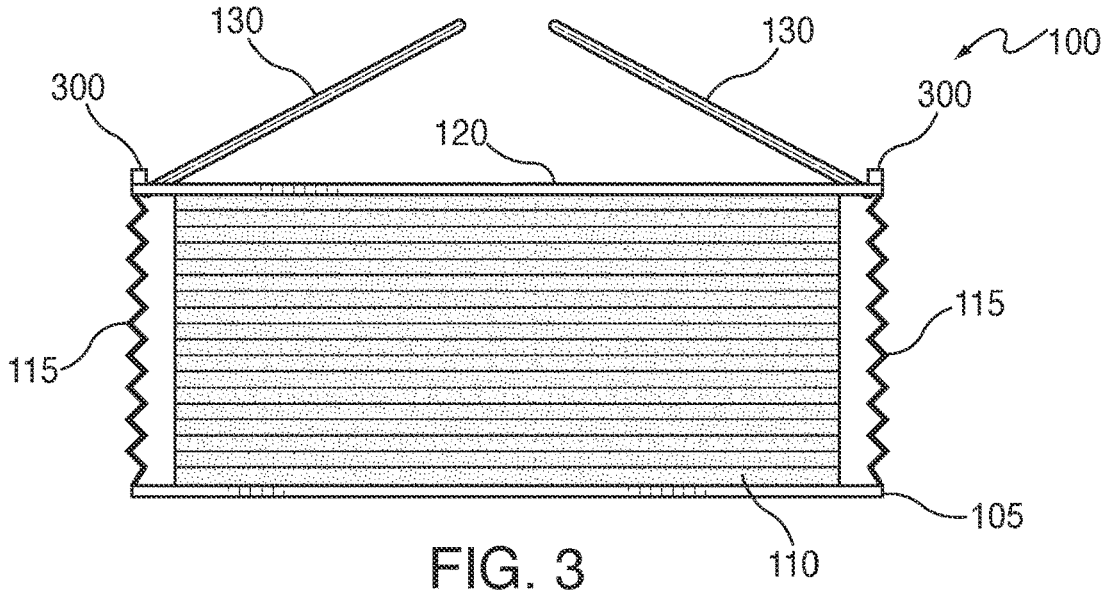
FIG. 3 is a side view of the collapsible shopping basket of FIG. 1 in expanded form.
Figure 4:
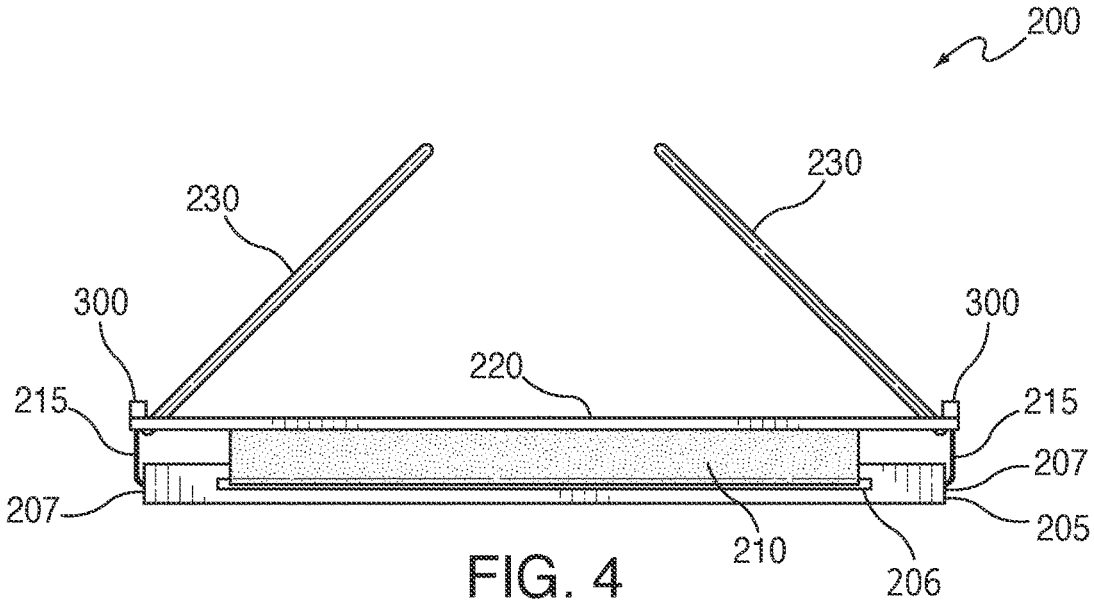
FIG. 4 a side view of a second embodiment of a collapsible shopping basket according to the present disclosure, in collapsed form.
Figure 5:
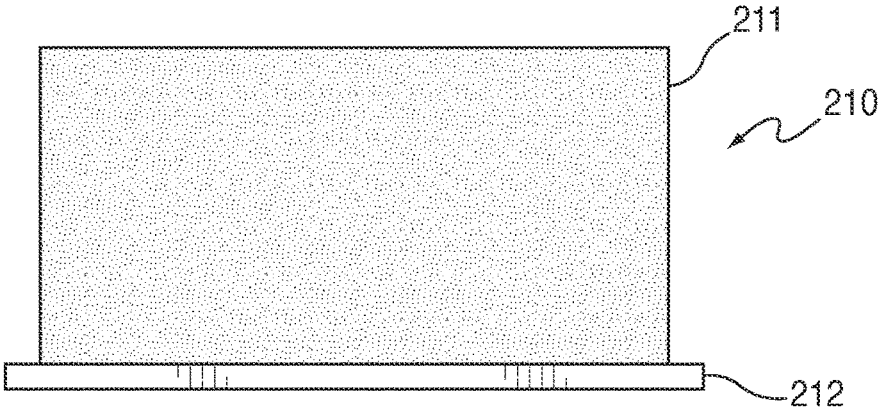
FIG. 5 is a side view of a flexible side panel of the collapsible shopping basket of FIG. 4.
Figure 6:
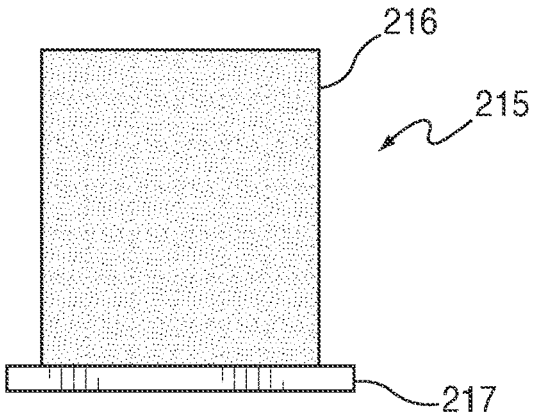
FIG. 6 is a side view of a flexible end panel of the collapsible shopping basket of FIG. 4.

Referring now to FIGS. 1 to 3, a first embodiment of a collapsible shopping basket 100 is shown which includes a rectangular base 105, two accordion side walls 110, two accordion end walls 115, a top rim 120, two handles 130 which are rotatably coupled to the top rim 120 preferably rotatably coupled so as to be foldable. The rectangular base 105 has two opposing sides, two opposing ends, and a central portion having a uniform image background suitable for acting as a background for product scanning. The central portion is selected to provide good contrast, uniform and consistent color, and be non-reflective. Latch mechanisms 300 may be provided on top rim 120 in each corner in order to hold the handles 130 in an open position, as discussed in more detail with respect to FIGS. 9 and 10 below. The accordion side walls 110 have a lower end secured to a top surface of the rectangular base 105 close to each respective adjacent side thereof and an upper end secured to the top rim 120. In the same manner, the accordion end walls 115 have a lower end secured to the top surface of the rectangular base 105 close to each respective adjacent end thereof and an upper end secured to the top rim 120. The top rim 120 is rectangular with two sides having about the same length as the sides of the rectangular base 105, and two ends having about the same length as the ends of the rectangular base 105. The accordion side walls 110 and the accordion end walls 115 are vertically collapsible and expand and contract so that the collapsible shopping basket 100 can move between the collapsed position shown in FIG. 2 and the expanded version shown in FIG. 3. In either position, the accordion side walls 110 and the accordion end walls 115 stay on the outer periphery of the rectangular base 105 so as to not obscure any part of the central portion of the rectangular base 105 when in the collapsed position thereof. This allows a customer to gather items to purchase while shopping, holding the handles 130 so that the accordion side walls 110 and the accordion end walls 115 expand due to the weight of the rectangular base 105 and thus forcing the collapsible shopping basket 100 into the expanded position shown in FIG. 3. The customer can then place the collapsible shopping basket 100 onto a predetermined scan area for a computer vision-based self-service checkout system. The collapsible shopping basket 100 will automatically collapse onto itself because of the weight of the top rim 120 and handles 130, thereby providing the computer vision-based self-service checkout system with a view of all of the items in the collapsible shopping basket 100. The accordion side walls 110 and the accordion end walls 115 may be formed from fabric, paper, vinyl or polyvinyl chloride (PVC), or aluminum, for example. The rectangular base 105, the top rim 120, and the handles 130 may be formed from a plastic, composite, wood, metal, or combinations thereof.

Figure 7:
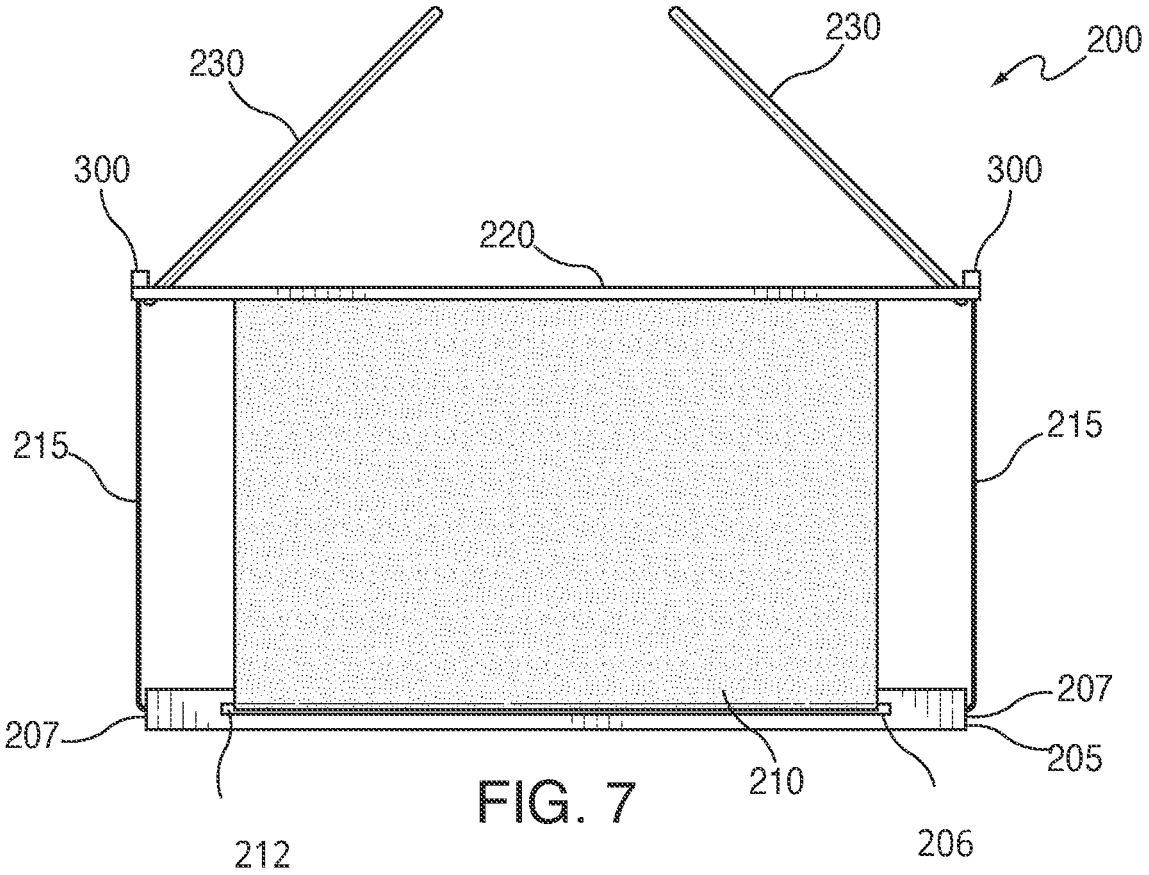
FIG. 7 is a side view of the collapsible shopping basket of FIG. 4, in expanded form.

Referring now to FIGS. 4 to 7, a second embodiment of a collapsible shopping basket 200 is shown which includes a rectangular base 205, two flexible side walls 210, two flexible end walls 215, a top rim 220, and handles 230 which are coupled to the top rim 220 preferably rotatably coupled so as to be foldable. Latch mechanisms 300 may be provided on top rim 220 in each corner in order to hold the handles 230 in an open position, as discussed in more detail with respect to FIGS. 9 and 10 below. Each flexible side wall 210 includes a flexible part 211 which forms the side portion of the wall and a rigid member 212. Each flexible end wall 215 includes a flexible part 216 which forms the end portion of the wall and a rigid member 217. The rectangular base 205 is hollow, with two slots 206 on each side portion thereof and two slots 207 on each end portion thereof. The rectangular base 205 also has a central portion having a uniform image background suitable for acting as a background for product scanning. The central portion is selected to provide good contrast, uniform and consistent color, and be non-reflective. Each slot 206 has a longitudinal length that is slightly longer than the width of the flexible part 211 of the flexible side wall 210 and slightly shorter than the width of the rigid member 212. Similarly each slot 207 has a longitudinal length that is slightly longer than the width of the flexible part 216 of the flexible end wall 215 and slightly shorter than the width of the rigid member 217 of the flexible end wall 215. Each flexible side wall 210 is positioned during assembly with the rigid member 212 within the hollow portion of the rectangular base 205 and the flexible part 211 passing through the associated slot 206 so that a top portion of the flexible part 211 can be coupled to the top rim 220. Similarly, each flexible end wall 215 is positioned during assembly with the rigid member 217 within the hollow portion of the rectangular base 205 and the flexible part 216 passing through the associated slot 207 so that a top portion of the flexible part 216 can be coupled to the top rim 220. Because the width of rigid member 212 is greater than the longitudinal length of slot 206, each flexible side wall 210 is captured within the rectangular base 205. Similarly, because the width of rigid member 217 is greater than the longitudinal length of slot 207, each flexible end wall 215 is captured within the rectangular base 205. The flexible nature of the two flexible side walls 210 and the two flexible end walls 215 allow movement between a collapsed position shown in FIG. 4, with most of the flexible part 211 of each flexible side wall 210 and most of the flexible part 216 of each flexible end wall 215 within the hollow portion of the rectangular base 205. When in use, e.g., when a customer is carrying collapsible shopping basket 200, the flexible part 211 of each flexible side wall 210 and the flexible part 216 of each flexible end wall 215 will slide out of the hollow portion of the rectangular base 205. This is shown in FIG. 7. In this manner, the flexible side walls 210 and flexible end walls 215 are also vertically collapsible. Each flexible side wall 210 and each flexible end wall 215 will be held slightly within the associated slot 206, 207 because of the associated rigid members 212, 217. Once shopping is completed, the customer places the collapsible shopping basket 200 onto a predetermined scan area for a computer vision-based self-service checkout system. The collapsible shopping basket 200 will automatically collapse onto itself because of the weight of the top rim 220 and handles 230 will force each flexible side wall 210 and each flexible end wall 215 to slide back into the hollow space of the rectangular base 205 so as to not obscure any part of the central portion of the rectangular base 205 when in the collapsed position thereof. This will provide the computer vision-based self-service checkout system with a view of all of the items in the collapsible shopping basket 200. The flexible side walls 210 and the flexible end walls 215 may be formed from an appropriate material such as fabric, paper, vinyl or polyvinyl chloride (PVC), or aluminum, for example. The rectangular base 205, the top rim 220, and the handles 230 may be formed from a plastic, composite, wood, metal, or combinations thereof.

Figure 8:
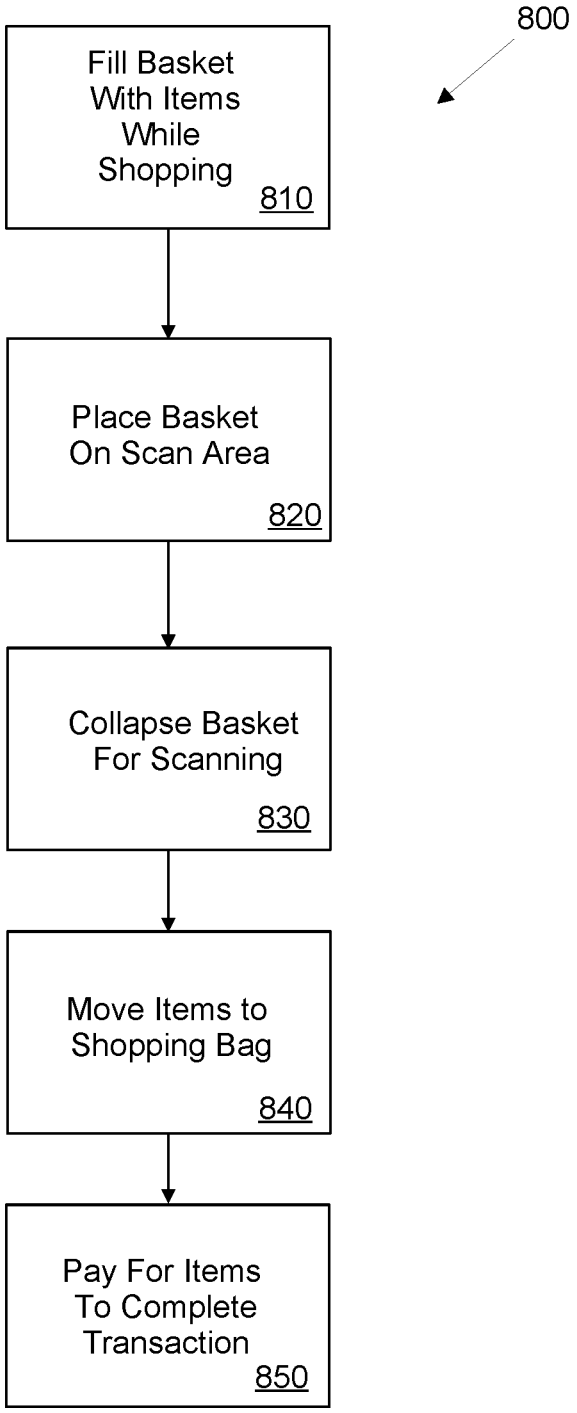
FIG. 8 is a flowchart showing a method of use of the collapsible basket of the present disclosure.

Referring now to FIG. 8, a flowchart 800 shows the use of the collapsible shopping basket 100, 200 of the present disclosure. In a first step 810, a customer fills the collapsible shopping basket 100, 200 with items for purchase. When the customer completes shopping, the customer places the collapsible shopping basket 100, 200 onto a scan area for a computer vision-based self-service checkout system (step 820). Next, the associated sidewalls of the collapsible shopping basket 100, 200 automatically collapse as discussed above, providing the computer vision-based self-service checkout system with a clear view of the items within the collapsible shopping basket 100, 200 for scanning (step 830). Once scanning is completed, the customer moves the items to a shopping bag or other means for conveyance in a completed checkout area (step 840) and then pays for the items to complete the transaction (step 850).

Figure 9:
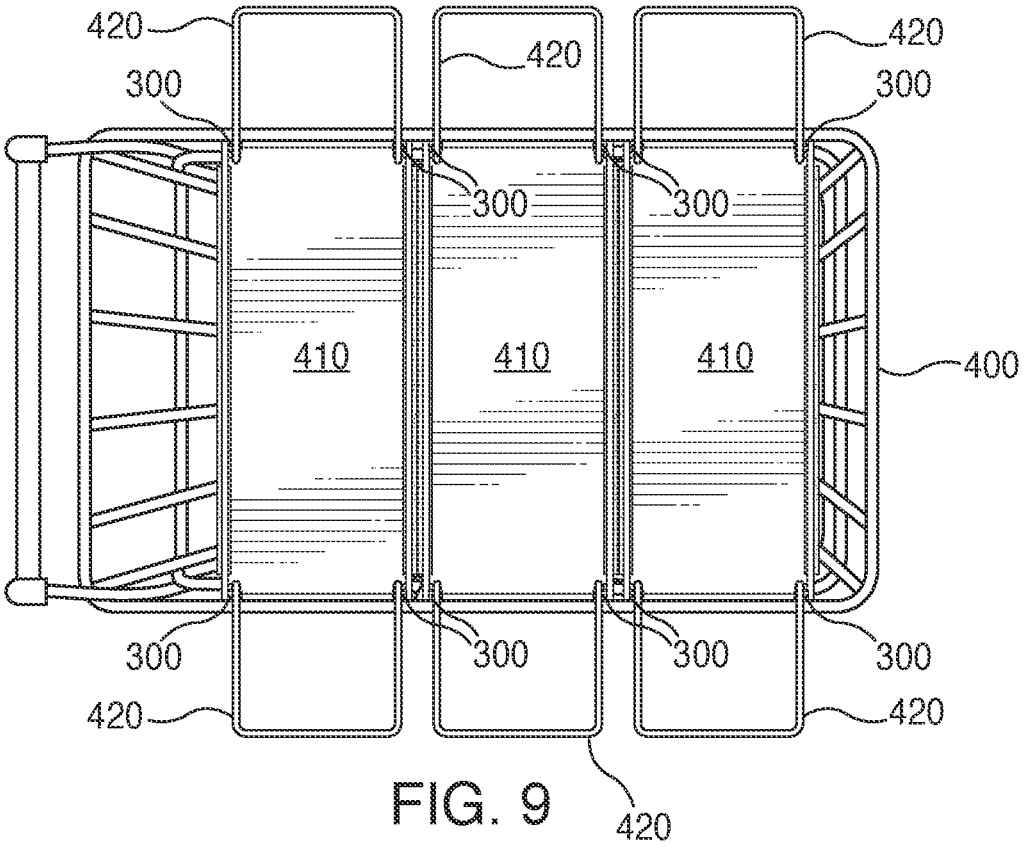
FIG. 9 is a top view of a shopping cart with three collapsible baskets positioned therein.
Figure 10:
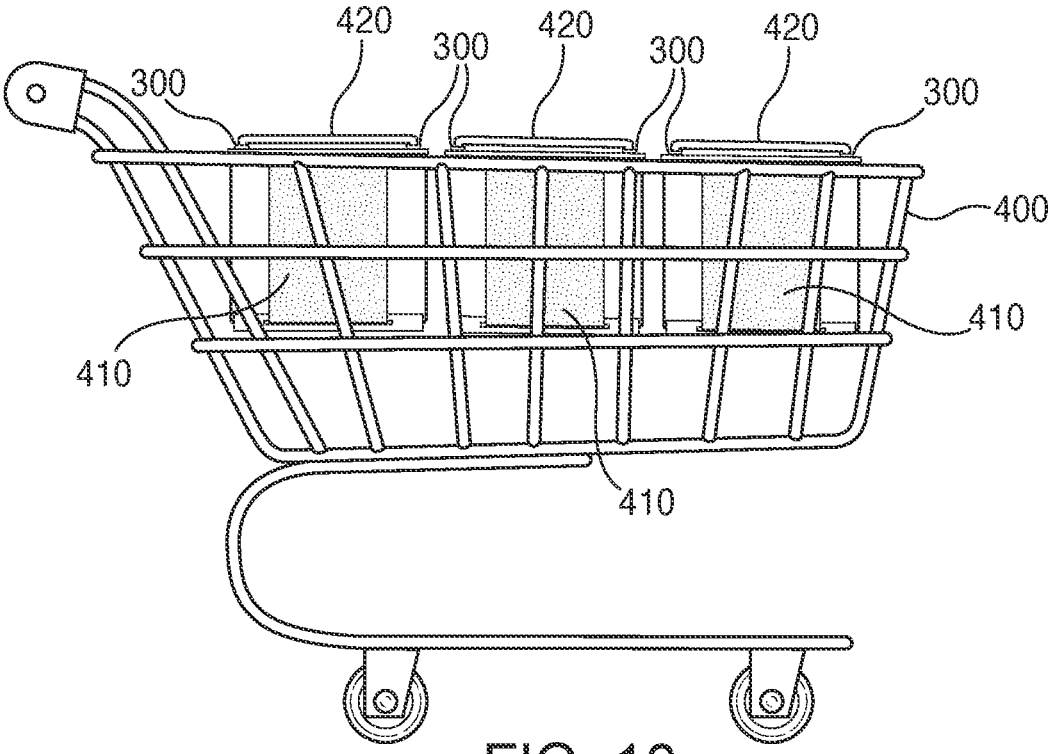
FIG. 10 is a side view of the shopping cart shown in FIG. 8 with three collapsible baskets positioned therein.

As discussed above, both embodiments of the collapsible shopping basket 100, 200 may include latch mechanisms 300 used to secure the handles 130, 230 into an open position. The latches may be snap fit, securing a portion of the handle 130, 230 completely open, but releasing the handle 130, 230 when enough pressure is applied for normal use. Referring now to FIGS. 9 and 10, the benefit of the latch mechanisms 300 is that a customer may use two or more of the collapsible shopping baskets 410 (three are shown in FIGS. 9 and 10, each may be one or the other of the two embodiments of collapsible shopping baskets 100, 200) positioned within a shopping cart 400 with the handles 420 held open by the associated latch mechanisms 300. The use of multiple collapsible shopping baskets 410 by a single customer can add to the throughput at checkout for larger establishments by allowing the customer to sequentially position each collapsible shopping basket 410 onto the scanning area of the computer vision-based self-service checkout system in order to increase the speed of checkout at larger establishments where a larger volume of items are purchased.

The collapsible shopping basket of the present disclosure enhances the shopping experience by providing a quicker checkout process. The collapsible shopping basket may include optional features to further enhance the shopping experience. In one further embodiment, the base may be adapted to provide a modular design with slots in basket to fit dividers and/or cup holders that are client specific (e.g., slots to matches the bottom of client-supplied soft drink cups). In another further embodiment, electrical contacts for connection at the self-checkout terminal or rechargeable batteries may be provided in the base that are coupled to power a ring of LED lights mounted on the top rim to further illuminate the items in the basket during scanning. In yet another further embodiment, electrical contacts for connection at the self-checkout terminal may provide a data connection to the self-checkout system for a status indicator or LCD display on the basket for use during checkout (e.g., displaying status information such green LED for paid, checkout instructions, reusable basket status, etc.), or for cameras embedded in the top rim to further enhance scan accuracy (e.g., by providing upward angled view of items). In a still further embodiment, the collapsible storage basket may be re-usable by the customer and may include a non-volatile memory for storing customer data allowing loyalty and payment information to be automatically loaded at checkout.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A collapsible shopping basket, comprising:

a rectangular base having two opposing sides, two opposing ends with a predetermined distance between the two opposing ends, and a central portion for supporting items to be purchased;

a top rim having two opposing sides and two opposing ends, an outer edge of each of the two opposing ends separated by the predetermined distance;

two separate vertically collapsible side walls, each coupled at a lower end to the rectangular base and at an upper end to an associated one of the two opposing sides of the top rim;

two separate vertically collapsible end walls, each coupled at a lower end to the rectangular base and at an upper end to an associated one of the two opposing ends of the top rim;

two handles rotably coupled to the top rim; and wherein each of the vertically collapsible side walls and each of the vertically collapsible end walls are separate from each other and are independently from each other movable between an expanded position and a collapsed position, and wherein each of the vertically collapsible side walls and each of the vertically collapsible end walls are positioned so as to not obscure any part of the central portion of the rectangular base when in the collapsed position thereof.

2. The collapsible shopping basket of claim 1, further comprising a latch mechanism coupled to the top rim for holding one of the two handles in an open position.

3. The collapsible shopping basket of claim 1, wherein collapsible side walls are formed from one or more of fabric, paper, vinyl or polyvinyl chloride (PVC), or aluminum.

4. The collapsible shopping basket of claim 1, wherein collapsible end walls are formed from one or more of fabric, paper, vinyl or polyvinyl chloride (PVC), or aluminum.

5. The collapsible shopping basket of claim 1, wherein the rectangular base is formed from one or more of plastic, composite, wood, metal, or combinations thereof.

6. The collapsible shopping basket of claim 1, wherein the top rim is formed from one or more of plastic, composite, wood, metal, or combinations thereof.

7. The collapsible shopping basket of claim 1, wherein the handles are formed from one or more of plastic, composite, wood, metal, or combinations thereof.

8. The collapsible shopping basket of claim 1, wherein the two vertically collapsible side walls have an accordion form.

9. The collapsible shopping basket of claim 1, wherein the two vertically collapsible end walls have an accordion form.

10. A collapsible shopping basket, comprising:

a rectangular base having two opposing sides, two opposing ends with a predetermined distance between the two opposing ends, and a central portion for supporting items to be purchased;

a top rim having two opposing sides and two opposing ends, an outer edge of each of the two opposing ends separated by the predetermined distance;

two separate vertically collapsible side walls having an accordion form, each coupled at a lower end to the rectangular base and at an upper end to an associated one of the two opposing sides of the top rim;

two separate vertically collapsible end walls, each coupled at a lower end to the rectangular base and at an upper end to an associated one of the two opposing ends of the top rim;

two handles coupled to the top rim; and wherein each of the vertically collapsible side walls and each of the vertically collapsible end walls are separate from each other and are movable independently from each other between an expanded position and a collapsed position, and wherein each of the vertically collapsible side walls and each of the vertically collapsible end walls are positioned so as to not obscure any part of the central portion of the rectangular base when in the collapsed position thereof.

11. The collapsible shopping basket of claim 10, wherein the two vertically collapsible end walls have an accordion form.

12. The collapsible shopping basket of claim 10, wherein the two handles are rotatably coupled to the top rim.

13. The collapsible shopping basket of claim 12, further comprising a latch mechanism coupled to the top rim for holding one of the two handles in an open position.

* * * * *